United States Patent [19]

Wich

[11] 4,408,718

[45] Oct. 11, 1983

[54] ELECTROMAGNETIC UNIT FUEL INJECTOR

[75] Inventor: Thomas J. Wich, Grand Rapids, Mich.

[73] Assignee: General Motors Corporation, Detroit, Mich.

[21] Appl. No.: 305,501

[22] Filed: Sep. 25, 1981

[51] Int. Cl.[3] ..... F02M 47/00

[52] U.S. Cl. ..... 239/88; 239/585

[58] Field of Search ..... 239/88, 89, 90, 91, 239/95, 585

[56] References Cited

U.S. PATENT DOCUMENTS 4,244,324 1/1981 Fenne ..... 239/585

*Primary Examiner*—Andres Kashnikow
*Assistant Examiner*—Jon M. Rastello
*Attorney, Agent, or Firm*—Arthur N. Krein

[57] ABSTRACT

An electromagnetic unit fuel injector includes a pump assembly having an externally actuated plunger reciprocable in a bushing means to define a variable volume pump chamber and a pressure actuated fuel injection nozzle. Fuel, at a suitable supply pressure, in a supply chamber is adapted to be in flow communication with the pump chamber by suitable passage means having a normally open, electromagnetic valve means controlling flow through a first portion thereof and a normally open servo control valve means, including a servo control valve and piston, controlling flow through a second portion thereof. Fuel injection during a pump stroke of the plunger is initiated by the controlled energization of the electromagnetic valve means to block return flow of fuel so as to effect closure of the servo control valve means whereby the fuel pressure can be further intensified to effect operation of the injection nozzle.

5 Claims, 3 Drawing Figures

ELECTROMAGNETIC UNIT FUEL INJECTOR

This invention relates to unit fuel injectors of the type used to inject fuel into the cylinders of a diesel engine and, in particular, to an electromagnetic unit fuel injector.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine driven cam whereby to pressurize fuel to a suitable high pressure so as to effect the unseating of a pressure actuated injection valve in a fuel injection nozzle that is incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow so as to permit the plunger to then intensify the pressure of fuel to effect unseating of the injection valve of the associated fuel injection nozzle. An exemplary embodiment of such an electromagnetic unit fuel injector is disclosed, for example, in U.S. Pat. No. 4,129,253 entitled Electromagnetic Unit Fuel Injector issued Dec. 12, 1978 to Ernest Bader, Jr., John I. Deckard and Dan B. Kuiper.

SUMMARY OF THE INVENTION

The present invention provides an electromagnetic unit fuel injector that includes a pump assembly having a plunger reciprocable in a bushing and operated by, for example, an engine driven cam, with flow from the pump during a pump stroke of the plunger being directed to a fuel injection nozzle assembly of the unit that contains a spring biased, pressure actuated injection valve therein for controlling flow out through the spray tip outlets of the injection nozzles. Fuel is also directed through a passage means, containing a normally open servo control valve means and a normally open solenoid actuated valve means in series, to a fuel supply passage means. Fuel injection is regulated by the controlled energization of the solenoid actuated valve means whereby it is operative to block flow from the passage means to the fuel supply passage means during a pump stroke of the plunger whereby the plunger is then permitted to intensify the pressure of fuel to a value to effect seating of the injection valve. The servo control valve means is operative to reduce the pressure of fluid against which the solenoid controlled valve means operates to a fraction of that required to effect unseating of the injection valve during the pump stroke of the plunger.

It is therefore a primary object of this invention to provide an improved electromagnetic unit fuel injector that contains a servo control valve means therein located between a pump plunger and a solenoid actuated valve means controlling injection whereby the solenoid need only operate against a fraction of the fluid pressure generated by the plunger for controlling the start and end of injection.

Another object of the invention is to provide an improved electromagnetic unit fuel injector having a solenoid actuated valve means and a servo control valve means incorporated therein that are operable upon the controlled energization of the solenoid to control the drain flow of fuel during a pump stroke and which is thus operative to control the beginning and end of injection.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
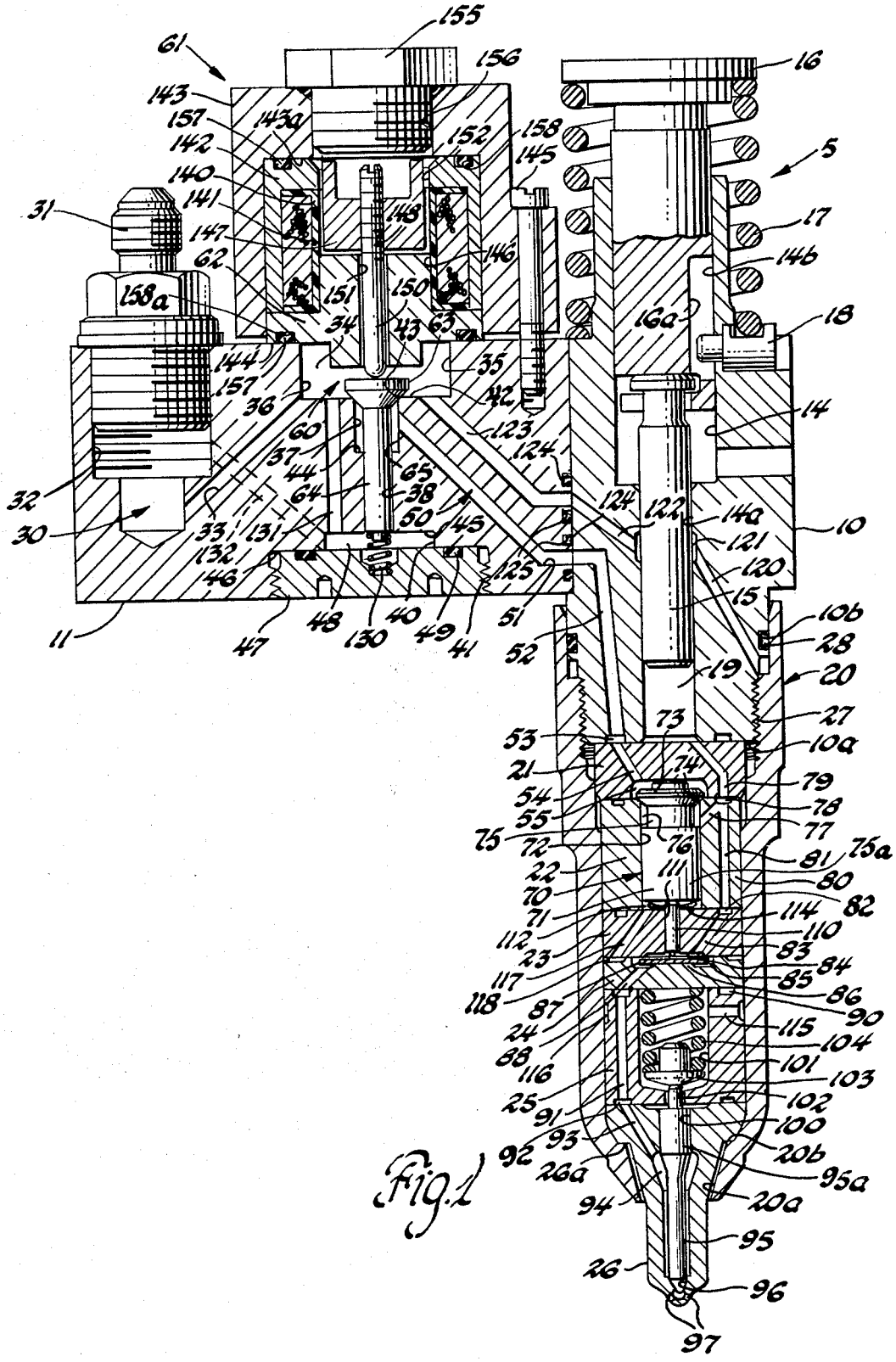
FIG. 1 is a longitudinal sectional view of an electromagnetic unit fuel injector in accordance with the invention, this view being taken along line 1—1 of FIG. 2, with elements of the injector being shown so that the plunger of the pump thereof is positioned as during a pump stroke and with the electromagnetic valve means thereof energized, and with parts of the unit shown in elevation.
Figure 2:
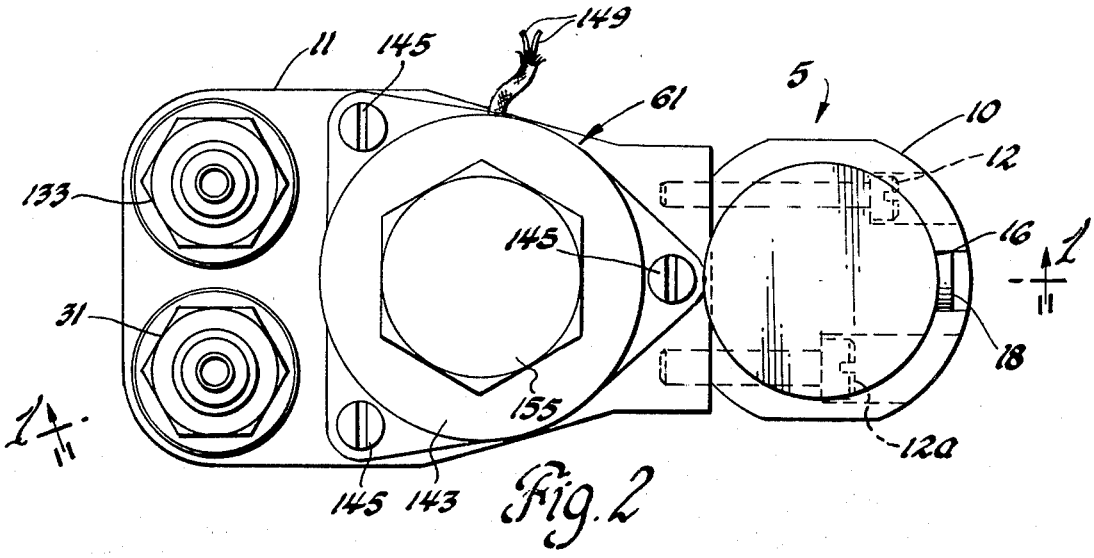
FIG. 2 is a top view of the electromagnetic unit fuel injector of FIG. 1.

Referring now to the drawings and in particular to FIGS. 1 and 2, there is shown an electromagnetic unit fuel injector, generally designated 5, constructed in accordance with the invention. This electromagnetic unit fuel injector 5 is, in effect, a unit fuel injector-pump assembly with an electromagnetic actuated valve, in the form of a solenoid and valve assembly incorporated therein, to control fuel injection from the injector portion of this assembly, a servo control valve means being used to control the pressure against which the solenoid must act to effect the injection of fuel from the assembly in a manner to be described.

In the construction illustrated in FIGS. 1 and 2, the electromagnetic unit fuel injector 5 is formed with a multi-piece housing which includes a hollow injector body 10 and a side body 11 suitably secured together, as by screws 12 and **12*a* which extend through suitable apertures provided for this purpose in the body 10 for threaded engagement in the side body 11, as best seen in FIG. 2**.

The injector body 10 is provided with a stepped bore 14 therethrough defining a cylindrical lower wall **14*a* of an internal diameter to slidably receive a pump plunger 15 and a cylindrical upper wall 14*b* of a larger internal diameter to slidably receive a plunger actuator follower 16**.

As shown in FIG. 1, the follower 16 extends out one end of the injector body 10 whereby it and the plunger 15 connected thereto are adapted to be reciprocated as by an engine driven cam or rocker, not shown, and by a plunger return spring 17 in a conventional manner. A stop pin 18 extends through a portion of the injector body into an axial extending groove 16*a* in the follower 16 whereby to limit upward travel of the follower.

The lower portion of the injector body 10 containing the wall 14*a* thus defines a bushing which with the plunger 15 reciprocable therein forms a pump chamber 19.

Forming an extension of and threaded to the lower end of the injector body 10 is a nut 20 within which is supported, starting in sequence from the top, a delivery cage 21, a valve bushing 22, a piston cage 23, a spring retainer 24, a spring cage 25, and the valve body or spray tip 26, hereinafter referred to as the spray tip, of a conventional fuel injection nozzle assembly.

As shown in FIG. 1, the nut 20 has an opening 20*a* at its lower end through which extends the lower end of the spray tip 26. At its other end the spray tip 26 is enlarged to provide a flat shoulder 26*a* which seats on a flat shoulder 20*b* provided by the counter-bore through the nut. The threaded connection 27 of the nut 20 to injector body 10 holds the delivery cage 21, valve bushing 22, piston cage 23, spring retainer 24, spring cage 25, and the spray tip 26 clamped and stacked end-to-end between the upper face of the spray tip 26 and the bottom face 10*a* of the injector body.

All of these above-described elements, formed as separate elements for ease of manufacture and assembly, have lapped mating surfaces whereby they are held in pressure sealed relation to each other. In addition, an annular seal, such as O-ring seal 28, is positioned, for example, in a suitable groove 10*b* provided for this purpose in the injector body 10 to effect a seal between the injector body 10 and nut 20 next adjacent to the upper end of the nut.

In operation, the electromagnetic unit fuel injector 5 would be supplied with fuel from a fuel tank via a conduit and supply pump, both not shown, with this fuel being supplied at a predetermined relatively low supply pressure, for example a supply pressure of 40 to 60 psi. This fuel is delivered via a supply passage means 30 and a passage means 50, both to be described in detail hereinafter, to the open end of the pump chamber 19 at the lower end of injector body 10. Flow between the supply passage means 30 and the passage means 50 is controlled by a solenoid actuated valve means or electromagnetic valve means 60 and a servo control valve means 70, both to be described in detail hereinafter.

For this purpose, a conventional apertured inlet or supply fitting 31, containing a filter, not shown, therein, is threaded into the internally threaded blind bore passage 32 extending downward from the top of the side body 11 and forming the inlet portion of the supply passage means 30.

The bore passage 32 communicates, via an upwardly inclined passage 33, with a supply chamber 34 difined in part by the upper enlarged diameter end of a stepped vertical bore 35 that extends through the side body 11 in the construction shown in FIG. 1. The bore 35 defines in succession a circular upper wall 36, an upper intermediate wall 37, an intermediate wall 38, a lower intermediate wall 40 and, a bottom internally threaded wall 41, for a purpose to be described. Both of the walls 37 and 38 are of progressively reduced internal diameters relative to the internal diameters of walls 36, 40 and 41. Walls 36 and 37 are connected by a flat surface 42 which terminates at an annular conical valve seat 43 that encircles a passage defined by the wall 37. Walls 37 and 38 are connected by a flat surface 44. Walls 39 and 40 are connected by a flat surface 45. Walls 40 and 41 are connected by a flat wall 46.

In the construction illustrated in FIG. 1, the chamber 34 is partly enclosed by the pole piece 62 of a solenoid assembly, generally designated 61, forming part of the solenoid actuated valve means 60, which is suitably fixed in a manner to be described to the upper surface of side body 11.

A closure cap 47 threadedly engaged with the threaded wall 41 has its upper surface defining, with the wall 40 and flat surface 45, a lower cavity 48. A suitable O-ring seal 49 positioned for example in an annular groove provided for this purpose in the closure cap, operates to effect a seal between the flat wall 46 and the upper surface of the closure cap 47.

The electromagnetic valve means 60 also includes a servo valve 63 that has its stem 64 reciprocably received by wall 38 whereby the seating surface of its valve head can be moved into and out of engagement with the valve seat 43. Valve stem 64 defines with the bore wall 37 an annular chamber 65 forming part of the passage means 50.

Passage means 50 further includes a connecting passage from chamber 65 defined by an inclined bore 51 provided in side body 11 and an inverted L-shaped bore 52 provided in injector body 10. The other end of this passage, that is the lower end of bore 52 communicates with an annular grooved passage 53 provided, for example, in the lower face 10*a* of injector body 10 radially outward from the bore 14 extending therethrough. An inclined passage 54 provided in the delivery cage 21 communicates at one end with the grooved passage 53 and at its other end with a recessed central control pressure chamber 55 provided by a blind bore extending upward from the lower face of the delivery cage 21.

Flow of fuel to and from the control pressure chamber 55 is controlled by means of the servo control valve means 70. This servo control valve means 70 includes a servo control valve 71 which has its stepped valve stem slidably received in the valve bore 72 that extends through the valve bushing 22. In the embodiment illustrated, valve 71 has an enlarged head 73 with an annular seating surface thereon adapted to cooperate with a conical valve seat 74 that encircles the upper end of the valve bore 72 in valve bushing 22. The stem of the servo control valve 71 is stepped and includes a reduced diameter upper stem portion 75 that defines with the valve bore 72 a pressure chamber 76 and a lower guide stem portion which is slidably guided by the wall defined by bore 72 in valve bushing 22.

Flow between the pump chamber 19 and pressure chamber 76, in the construction illustrated, is via an inclined passage 77 provided in valve bushing 22 so as to extend upward from the pressure chamber 76 to an annular grooved passage 78, formed in the upper surface of the valve bushing 22 for flow communication with the lower end of a vertically oriented delivery passage 79 provided in the delivery cage 21 so as to open at its upper end into the pump chamber 19.

During a pump stroke of plunger 15, fuel is adapted to be discharged from pump chamber 19 via delivery passage 79 and grooved passage 78 into the inlet end of a discharge passage means 80 to be described next hereinafter.

An upper part of this discharge passage means 80, with reference to FIG. 1, includes a vertical passage 81 extending from groove 78 through valve bushing 22 for flow communication with an annular groove 82 provided, for example, in the upper surface of piston cage 23. This groove 82 communicates via a downwardly inclined passage 83 in piston cage 23 with a central chamber 84 formed in bottom of the piston cage.

As shown in FIG. 1, the spring retainer 24 is also provided with an enlarged chamber 85 formed therein so as to face the chamber 84 and, projecting upwardly from the bottom of the chamber 85 is a protuberance 86 which forms a stop for a circular flat disc check valve 87. The chamber 85 extends laterally beyond the extremities of the opening defining chamber 84 whereby the lower end surface of the piston cage 23 will form a seat for the check valve 87 when in a position to close the opening of chamber 84.

At least one inclined passage 88 is also provided in the spring retainer 24 to connect the chamber 84 and 85 and in particular the lower chamber 85 with an annular groove 90 in the upper end of spring cage 25. This groove 90 is connected with a similar annular groove 92 on the bottom face of the spring cage 25 by a longitudinal passage 91 through the spring case. The lower groove 92 is, in turn, connected by at least one inclined passage 93 to a central passage 94 surrounding a needle valve 95 movably positioned within the spray tip 26. At the lower end of passage 94 is an outlet for fuel delivery with an encircling tapered annular seat 96 for the needle valve 95 and, below the valve seat are connecting spray orifices 97 in the lower end of the spray tip 26.

The upper end of spray tip 26 is provided with a bore 100 for guiding opening and closing movements of the needle valve 95. The piston portion **95*a* of the needle valve slidably fits this bore 100 and has its lower end exposed to fuel pressure in passage 94 and its upper end exposed to fuel pressure in the spring chamber 101 via an opening 102, both being formed in spring cage 25. A reduced diameter upper end portion of the needle valve 95 extends through the central opening 102 in the spring cage and abuts a spring seat 103. Compressed between the spring seat 103 and the spring retainer 24 is a coil spring 104 which biases the needle valve 95** to its closed position shown.

Figure 3:
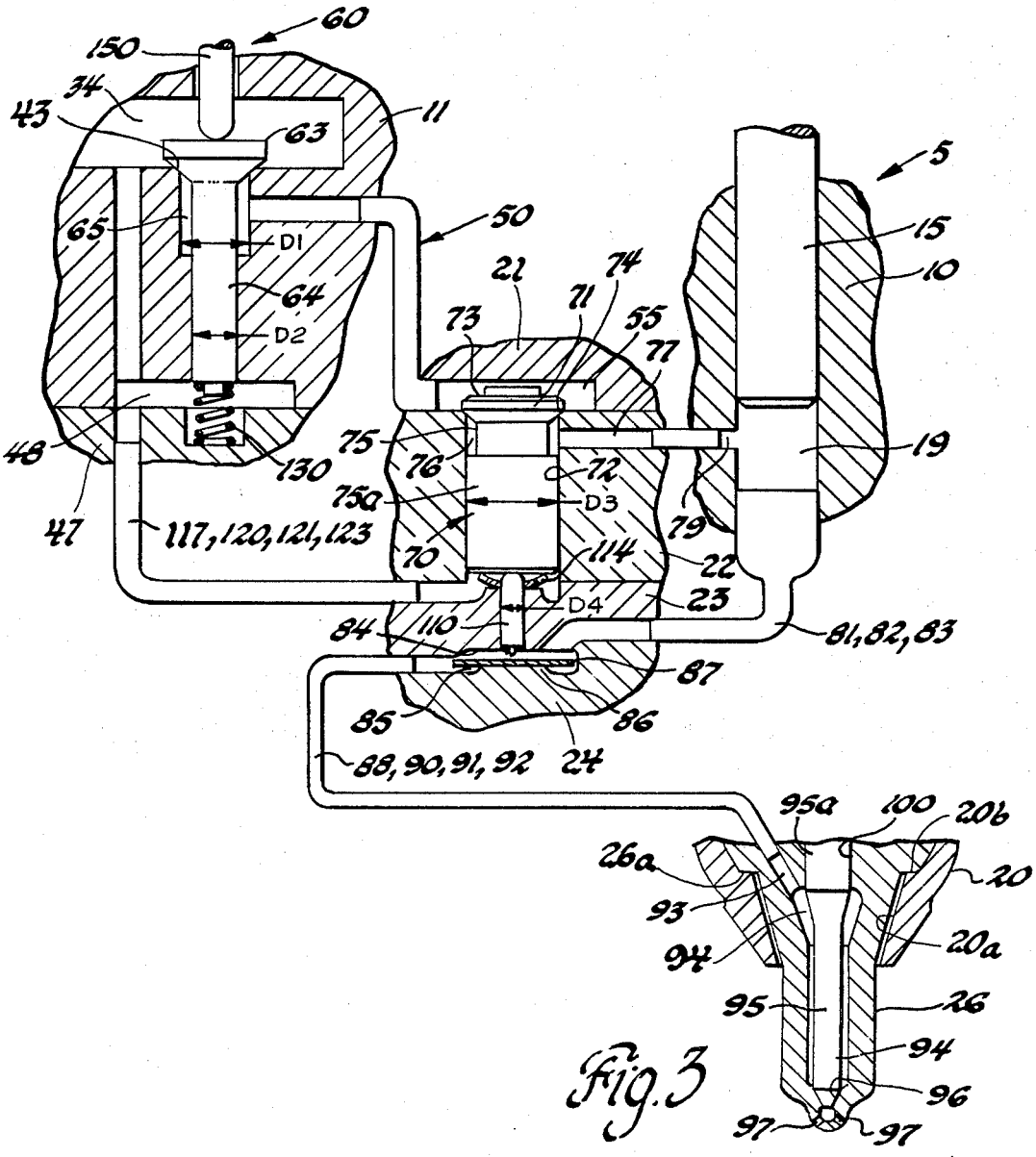
FIG. 3 is a schematic illustration of the primary operating elements of an electromagnetic unit fuel injector constructed in accordance with the invention, with the plunger shown during a pump stroke and with the electromagnetic valve means energized.

Referring now again to the servo control valve means 70, this valve means further includes a piston 110 that is slidably received in a central bore 111 provided in the piston cage 23. As best seen in FIGS. 1 and 3, the lower end of this piston 110 is exposed to the pressure of fuel with the chamber 84, while its upper end projects into a chamber 112, defined by valve bore 72 in valve bushing 22 and the opposed faces of servo control valve 71 and piston cage 23, for abutment against the bottom surface of the lower stem portion **75*a* of servo control valve 71. A washer type, wave spring 114, is positioned in the chamber 112 so as to loosely encircle piston 110 in position to normally bias the servo control valve 71 to an open position relative to the associate valve seat 74**.

The lower end of the piston 110 is preferably crowned or, as shown in FIGS. 1 and 3, is formed with an axial protuberance whereby to allow pressurized fuel to act against the lower bottom end of the piston in the event it is engaged by check valve 87 so that it will be operative to effect opening movement of the servo control valve 71 in a manner to be described in detail hereinafter.

As shown in FIG. 1, in order to prevent any tendency of fuel pressure to build up in the spring chamber 101, this chamber is vented through a radial passage 115 to an annular groove 116 provided on the outer peripheral surface of spring cage 25. For the same reason, chamber 112 is vented via an inclined passage 117 to an annular groove 118 provided, for example on the upper outer peripheral edge surface of spring retainer 24. While a close fit exists between the nut 20 and the spring retainer 24, piston cage 23, valve bushing 22 and delivery cage 21, there is sufficient diametral clearance between these parts and also between the threaded connection 27 of nut 20 with injector body 10 for the venting of fuel back to a relatively low pressure area, such as at the supply chamber 34.

In the construction illustrated, this fuel is drained back to the supply chamber 34 via an inclined passage 120 in injector body 10 which opens into an annular groove 121 encircling plunger 15 and then via an inclined passage 122 which connects with a drain passage 123 provided in side body 11 for flow communication with the supply chamber 34.

Suitable seals, such as O-ring seals 124 positioned, for example, in annular grooves 125 provided for this purpose in side body 11 so as to encircle passage 51 and drain passage 123, effect fluid seals between the injector body 10 and side body 11.

Referring now again to the electomagnetic valve means 60, the valve 63 thereof is normally biased to an open position relative to the associate valve seat 43 by means of a coiled spring 130 positioned in chamber 48 with one end thereof in abutment against closure cap 47 and its other end in abutment against the stem 64 of this valve 63. As shown in FIGS. 1 and 3, chamber 48 is also in flow communication with the supply chamber 34 by means of a vertical interconnecting passage 131 formed in side fitting 11 so as to extend substantially parallel to the axis of bore 35. Chamber 48 is also in flow communication via an inclined passage 132 with an internally threaded blind bore passage, not shown, that extends downward from the top of side body 11, in parallel spaced apart relation to bore passage 32 and which has an apertured return fitting 133 (FIG. 2) threaded therein. Fitting 133 is adapted to be connected via a conduit containing a flow restrictor therein, both not shown, to a fuel reservoir containing fuel at substantially atmospheric pressure. The flow restriction, not shown, as well known in the art is appropriately sized for maintaining the desired supply pressure in the injectors used in a particular engine application.

The valve 63 is adapted to be moved to the closed position, shown in both FIGS. 1 and 3, by the actuation of the solenoid assembly 61. As best seen in FIG. 1, the solenoid assembly 61 includes a tubular coil bobbin 140 supporting a wound wire coil 141. Bobbin 140 is positioned in a solenoid case 142 which in turn is positioned in an inverted cup-shaped cover 143 between the internal wall **143*a* of cover 143 and the upper flanged surface of the pole piece 62. As shown, the cover 143 is suitably secured, as by screws 145, to the upper face of side body 11 with the bottom flange surface 144 of pole piece 62 in abutment against the upper surface of side body 11**.

As should now be apparent to those skilled in the art, the side body 11 is preferably made of a suitable non-magnetic material, such as non-magnetic stainless steel or aluminum, or, alternately, a non-magnetic washer like or gasket member, not shown, should be positioned between pole piece 62 and side body 11.

Coil 141 is connectable by electrical leads 149 (FIG. 2), which extend through suitable openings, not shown, provided for this purpose in solenoid case 142 and cover 143, to a suitable source of electrical power via a conventional fuel injection electronic control circuit, not shown, whereby the solenoid can be energized as a function of the operating conditions of an engine in a manner well known in the art.

The pole piece 62 has a reduced diameter upper boss portion which extends axially into the central bore 146 of bobbin 140 a predetermined axial distance. The armature 147 of the solenoid assembly is slidably received in the upper portion of bore 146 and in the central bore 152 of solenoid case 142 for movement relative to pole piece 144.

Armature 147 is provided with an internally threaded axial bore 148 which adjustably threadingly receives the threaded end of a valve actuator rod 150 whereby this rod will extend axially downward from the armature. Rod 150 is of an external diameter whereby it will loosely extend through a through bore 151 in pole piece 144 into abutment against the upper head surface of valve 63.

The armature 147 is thus slidably positioned for vertical movement between a lowered position, the position shown in FIG. 1, whereby the rod 150 effects closure of valve 63 a predetermined raised position as biased thereto by the force of spring 130 acting through valve 73. In the construction illustrated, the extent of the raised position is established by engagement of the upper end of armature 147 against the lower end surface of a closure plug 155 adjustably threaded into the internally threaded bore 156 provided in the base of cover 143.

Suitable annular seals, such as O-ring seals 157 positioned in annular grooves 158 and **158*a* provided for this purpose in solenoid case 142 and in pole piece 62, respectively. The seal 157 in groove 158 is used to effect a seal between solenoid case 142 and cover 143 while the seal 157 in groove 158*a* is used to effect a seal between pole piece 62 and side body 11**.

Referring now in particular to FIGS. 1 and 3, during engine operation fuel is supplied at a predetermined supply pressure through the supply fitting 31 to supply chamber 34. With the coil 141 of solenoid assembly 61 de-energized, the spring 130 is operative to open valve 63 and to also effect movement of the armature 147 to its raised position. With the valve 63 in its open position, fuel can then flow from inlet chamber 34 via chamber 65 and the remainder of the passage means 50 to the control pressure chamber 55. From this latter chamber 55, fuel can then flow via the then open servo control valve 71, normally held open by the force of spring 114, into pressure chamber 76 and then via the associate passages 77, 78 and 79 to the pump chamber 19 to permit filling of this chamber with fuel during a suction stroke of the plunger 15.

Thereafter, as the follower 16 is then driven downward to effect downward movement of the plunger 15 on a pump stroke and with the coil 141 still de-energized, this downward movement of the plunger will cause fuel to be displaced so as to cause the pressure in the pump chamber 19 and in adjacent connected passages to rise to a pressure level that is a predetermined amount less than the "pop" pressure required to lift needle valve 95 against the force of its associate return spring 104.

During this period of time the fuel displaced from the pump chamber 19 can flow via the then opened valves 71 and 63 back to the supply chamber 34 via the passages and chambers previously described. The pressure level attained during this portion of the pump stroke of plunger 15 is predetermined and is controlled by proper sizing of the flow passages and the flow areas defined by the respective valves 63 and 71 when in their open positions.

Thereafter, during the continued downward stroke of plunger 15, an electrical (current) pulse of finite characteristic and duration (timed relative to the top dead center of the associate engine piston position with respect to the camshaft and rocker arm linkage, not shown) applied through leads 149 to the coil 141 produces an electromagnetic field attracting the armature 147 to move toward the pole piece 62 so as to effect seating of valve 63 against its associate valve seat 43, the position of these elements shown in FIG. 1.

This then permits plunger 15 to increase (intensify) the fuel pressure first to a pressure level at which fuel in the control pressure chamber 55 reaches a predetermined control pressure level which is operative to then effect closing of the servo control valve 71 against the force of the wave spring 114 and the then force exerted by piston 110 in a valve opening direction. Upon the closure of the servo control valve 71, the plunger 15 is still operative to further intensify the pressure of the fuel to a "pop" pressure level to effect unseating of needle valve 95 so as to then permit the injection of fuel out through the spray orifices 97, the injection pressure increasing during further downward motion of the plunger.

Ending of the current pulse causes the electromagnetic field to collapse allowing the pressure in chamber 65 to open valve 63 and to also move the armature 147 to its raised position. Opening of the valve 63 effecting fluid flow then from chamber 65 to supply chamber 34, permits the rapid release of control pressure from the control pressure chamber 55. As this occurs the then high fuel pressure in chamber 84 acting on the free lower end of piston 110 will effect upward movement of the piston so as to lift the servo control valve 71 to its unseated position relative to valve seat 74 thereby effecting a release of the system pressure in the discharge passage means 80 and in the associate passages extending into the spray tip 26 toward supply pressure. As the pressure in the spray tip passage 94 is partially released, the spring 104 is then again operative to close valve 95 whereby to effect termination of injection. Simultaneous with a decrease in pressure in the discharge passage means, the check valve 87 is then operative to seat against the bottom surface of the piston cage 23 surrounding chamber 84. As known in the art, the check valve 87 is operative to keep high pressure combustion gases from blowing back through the injector in the event that the needle valve 95 is momentarily held open between injection cycles by a small dirt particle.

In addition as the pressure in the control pressure chamber 55 is reduced toward supply pressure, the spring 114 will again become operative to now hold the servo control valve 71 in its normally open position.

By proper sizing of the piston 110 and of the servo control valve 71, the control pressure in the control pressure chamber 55 can be maintained as a small fraction of the "pop" and maximum injection pressures and, the lower such control pressure the less force required of the solenoid assembly 61 to hold the servo valve 63 closed during an injection cycle of the unit injector.

By way of example, and as used in a particular embodiment and as shown with reference to the schematic illustration of FIG. 3, the internal diameter D1 of chamber 65 and the external diameter D2 of the stem 64 of servo valve 63 were 6.0 mm and 4.0 mm, respectively.

The outside diameter D3 of the servo control valve 71 and the outside diameter D4 of piston 110 were 8.0 mm and 2.0 mm respectively. The force of the spring 114 was less than approximately 1.2 pounds.

With this arrangement and with the fuel supplied at a pressure of approximately 60 psi, when the solenoid coil 141 was energized during operation of that unit injector, the pressure of fuel in the control pressure chamber 55 and within the chamber 65 and associate passage means 50 was approximately 1000 psi, with maximum injection pressure and therefore the pressure in chamber 76 being approximately 15000 psi. Thus in this application the force closing and holding the servo control valve 71 closed was approximately 74 pounds. The force applied by piston 110 in a valve opening direction was approximately 72.8 pounds which together with the force of spring 114 was sufficiently less than required to effect opening of the valve as long as the control pressure of 1000 psi was maintained in pressure control chamber 55. Of course as soon as the pressure in chamber 55 is released then the piston 110 would be operative to rapidly open the servo control valve 71.

In this application, the force of spring 130 was approximately 1 pound and since the maximum differential pressure acting on the servo valve 63 in a valve opening direction was only approximately 23 pounds, the solenoid assembly 61 was only required to provide a force of little more than approximately 24 pounds to effect and maintain closure of the servo valve 63 during energization of coil 141 so as to effect an injection cycle of the unit.

By way of example, in this same application, the air gap between the armature 147 and pole piece 62, and therefore the length of stroke of the armature 147, was 0.11 mm, while the stroke of the servo control valve 71 between its closed and full open position relative to the valve seat 74 was approximately 0.10 mm to 0.12 mm in length.

Thus by the use of the servo control valve means in accordance with a feature of the invention and by way of the example of the particular application described hereinabove, the ratio between the injection pressure and the control pressure during an injection cycle was 15:1 so that, in effect, the electromagnetic valve means 60 which is used to control the start of injection needed to operate against approximately only 1/15 of the injection pressure being generated during an injection cycle.

It will thus now be apparent that by appropriately making the effective area of the servo control valve 71 substantially greater than the effect area of piston 110, as desired, the pressure required to close and maintain closure of the servo control valve 71 can be substantially reduced accordingly relative to "pop" and injection pressure. Thus by way of example, if the effective area of the servo control valve 71 is approximately 15 times greater than the effective area of the piston 10, then only 1000 psi pressure is required to close and maintain closure of the servo control valve with 15,000 psi injection pressures.

The embodiments of the invention in which an exclusive property or privilege is claimed are defined as follows:

1. An electromagnetic unit fuel injector including a housing means having fuel passage means for the ingress and egress of fuel at a suitable supply pressure; a pump cylinder means in said housing means; an externally actuated plunger reciprocable in said cylinder means and defining therewith a pump chamber open at one end for discharge of fuel during a pump stroke and for fuel intake during a suction stroke of said plunger; said housing means including a valve body having a spray outlet at one end thereof for the discharge of fuel; an injection valve means movable in said valve body to control flow from said spray outlet; a discharge passage means connecting the said pump chamber to said spray outlet; and, a valve controlled passage means connecting said fuel passage means to said discharge passage means adjacent to said pump chamber; said valve controlled passage means including a solenoid actuated valve means controlling flow communication with said fuel passage means, a stepped servo control valve means and a control pressure passage means interconnecting said solenoid actuated valve means and said servo control valve means; said servo control valve means including a servo control valve controlling flow between said control pressure passage and said discharge passage means and a piston operatively connected at one end to said servo control valve and having its other end exposed to the pressure of fuel in said discharge passage means, the effective area of said servo control valve being substantially greater than the effective area of said piston.

2. An electromagnetic unit fuel injector including a housing means having fuel passage means for the ingress and egress of fuel at a suitable supply pressure; a pump cylinder means in said housing means; an externally actuated plunger reciprocable in said cylinder means and defining therewith a pump chamber that is open at one end for the discharge of fuel during a pump stroke and for fuel intake during a suction stroke of said plunger; said housing means including a valve body having a spray outlet at one end thereof for the discharge of fuel; an injection valve means movable in said valve body to control flow from said spray outlet; a discharge passage means connecting said pump chamber to said spray outlet; and, a valve controlled passage means, including a solenoid actuated valve means and a servo control valve means interconnected by a control pressure passage means; said servo control valve means including a servo for controlling flow between said control pressure passage means and said discharge passage means and a piston operatively associated at one end with said servo control valve and at its other end being exposed to the pressure of fuel in said discharge passage means; said solenoid actuated valve means being operative to control the flow of fuel between said fuel passage means and said control pressure passage means, the effective area of said servo control valve being substantially greater than the effective area of said piston whereby said servo piston valve means is operative to substantially reduce the pressure of fuel against which the solenoid actuated valve means must close against during a pump stroke of the plunger to allow said plunger to effect pressurization of fuel sufficiently to effect opening of said injection valve means.

3. An electromagnetic unit fuel injector including a housing means having a fuel passage means connectable to a source of fuel at a suitable supply pressure and for the return of fuel at said supply pressure; a pump cylinder means in said housing means; an externally actuated plunger reciprocable in said cylinder means; said cylinder being open at one end for discharge of fuel during a pump stroke and for fuel intake during a suction stroke of said plunger; said housing means including a valve body having a spray outlet at one end thereof for the discharge of fuel; an injection valve means movable in said valve body to control flow from said spray outlet; a discharge passage means connecting the open end of said cylinder to said spray outlet; and, a valve controlled passage means, including a normally open solenoid actuated valve and a normally open servo control valve means having a spring biased servo control valve and an actuator piston operatively associated therewith, interconnecting said fuel passage means with said discharge passage means, said solenoid actuated valve being operative to control the ingress of fuel from said fuel passage means to said cylinder during a suction stroke of said plunger and the pressurization of fuel during a pump stroke of said plunger, the effective area of said servo control valve being substantially greater than the effective area of said piston whereby said servo piston valve means is operative to substantially reduce the pressure of fuel against which the solenoid actuated valve must close against upon energization thereof during a pump stroke of the plunger to allow the pressurization of fuel to a level so as to effect opening of said injection valve means.

4. An electromagnetic unit fuel injector including a housing means having an externally actuated pump assembly therein; a pressure actuated fuel injection nozzle operatively associated with said housing means; a discharge passage means in said housing means operatively connecting said pump assembly to said injection nozzle; said housing means having a supply passage means and an interconnected return passage means connectable for the ingress and egress of fuel at a suitable supply pressure; and, a valve controlled passage means interconnecting said supply passage means to said discharge passage means; said valve controlled passage means including a normally open, solenoid actuated valve means positioned to control flow communication with said supply passage means, a normally open, servo control valve means and a control pressure passage means extending operatively positioned between said solenoid actuated valve means and one end of said servo control valve means; said servo control valve means including a spring biased servo control valve and a piston, each having a portion thereof positioned so as to be acted upon by fuel pressure in said discharge passage means, the effective area of said servo control valve subjected to the pressure of fuel in said control pressure passage means being substantially greater than the effective area of said piston subjected to the pressure of fuel in said discharge passage means whereby during operation on a pump stroke of said pump assembly, the pressure in said control pressure passage means against which the solenoid actuated valve means must close to initiate start of injection is substantially less than the pressure in said discharge passage means required to effect opening of said fuel injection nozzle.

5. An electromagnetic unit fuel injector adapted to be disposed in timed operative relationship to the combustion chamber of an internal combustion engine in response to an electronic control unit, said injector including a housing means having a supply passage means connectable to a source of fuel for the ingress of fuel at a suitable supply pressure and an interconnected return passage means for the egress of fuel; a pump cylinder means in said housing means; an externally actuated plunger reciprocable in said cylinder means and defining therewith a pump chamber; a fuel injection nozzle operatively associated with said housing means; a discharge passage means connecting said pump chamber to said fuel injection nozzle; and, a valve controlled passage means interconnecting said supply passage means with said discharge passage means, said valve controlled passage means including a solenoid actuated valve means adapted to be selectively energized by the electronic control unit for controlling the pressurization of fuel during a pump stroke of said plunger to a level to effect discharge of fuel from said fuel injection nozzle, a servo control valve means and a control pressure passage for flow connecting said solenoid actuated valve means with said servo control valve means, said servo control valve means including a servo control valve and a piston operatively associated therewith, said solenoid actuated valve means being operative to control the ingress of fuel to said pump chamber during a suction stroke and the pressurization of fuel during a pump stroke of said plunger, said servo control valve having an effective area subjected to the pressure in said control pressure passage which is substantially greater than the effective area of said piston that is subjected to the fuel pressure in said discharge passage means whereby said servo control valve means is operative to substantially reduce the pressure of fuel in said control passage means against which the solenoid actuated valve means must close during a pump stroke of said plunger to allow the pressurization of fuel to a level to effect operation of said fuel injection nozzle.

* * * * *